US007048148B2

(12) United States Patent
Roekens et al.

(10) Patent No.: US 7,048,148 B2
(45) Date of Patent: May 23, 2006

(54) LIQUID DISPENSING DEVICE

(75) Inventors: Jurgens Roekens, Steenokkerzeel (BE); Paul Haskayne, Lower Peover (GB); Gary A. Short, Kirkby-in-Ashfield (GB)

(73) Assignee: The Coca-Cola Company, Atlanta, GA (US)

( * ) Notice: Subject to any disclaimer, the term of this patent is extended or adjusted under 35 U.S.C. 154(b) by 0 days.

(21) Appl. No.: 10/822,863

(22) Filed: Apr. 13, 2004

(65) Prior Publication Data

US 2004/0217129 A1 Nov. 4, 2004

Related U.S. Application Data

(63) Continuation-in-part of application No. 10/370,074, filed on Feb. 21, 2003.

(60) Provisional application No. 60/533,243, filed on Dec. 31, 2003.

(51) Int. Cl.
*B67D 5/56* (2006.01)

(52) U.S. Cl. ..... 222/129.2; 222/145.6

(58) Field of Classification Search ..... 222/129.1, 222/129.2, 129.3, 129.4, 145.6
See application file for complete search history.

(56) References Cited

U.S. PATENT DOCUMENTS

| | | | | |
|---|---|---|---|---|
| 3,643,688 | A * | 2/1972 | Meinert | 137/556 |
| 3,949,903 | A * | 4/1976 | Benasutti et al. | 222/129.2 |
| 4,021,151 | A * | 5/1977 | Barthalon | 417/417 |
| 4,817,825 | A * | 4/1989 | Freese | 222/129.2 |
| 5,265,520 | A * | 11/1993 | Giuliano | 99/323.1 |
| 6,223,948 | B1 * | 5/2001 | Davis | 222/132 |
| 2004/0026451 | A1 * | 2/2004 | Jones | 222/129.1 |

* cited by examiner

*Primary Examiner*—Joseph A. Kaufman
(74) *Attorney, Agent, or Firm*—Michael J. Bell; Howrey LLP

(57) ABSTRACT

A drink dispensing head incorporating a Venturi valve to utilize the motive force of a high pressure liquid to draw a low pressure liquid into the dispensing head without the need for a pumping means. A Venturi valve incorporated into a remote valve structure for adding a bonus flavor to a regular beverage dispenser without altering the existing valve structure.

24 Claims, 8 Drawing Sheets

LIQUID DISPENSING DEVICE

CROSS-REFERENCE TO RELATED APPLICATIONS

This application is a non-provisional application of U.S. Provisional Application No. 60/533,243, entitled "LIQUID DISPENSING DEVICE", filed on Dec. 31, 2003, and is a continuation-in-part of U.S. patent application Ser. No. 10/370,074, filed Feb. 21, 2003 entitled "LIQUID DISPENSING DEVICE", the disclosures of which are hereby incorporated by reference in their entireties.

BACKGROUND

1. Field of the Invention

The present invention relates generally to a soft drink dispensing machine. More specifically, the present invention relates to a soft drink dispensing machine device having a post mix dispensing head with an integrated bonus flavor Venturi valve. Even more specifically, the invention is directed to an external post mix dispensing head that utilizes motive energy from part of a water feed to entrain and mix a bonus flavor into a regular final beverage.

2. Related Art

Soft drink dispensing machines are well known. Examples of known soft drink dispensing machines include U.S. Pat. Nos. 4,781,310 and 4,801,048, both entitled "Beverage Dispenser," U.S. Pat. No. 5,190,188, entitled "Convertible Beverage Dispenser," and U.S. Pat. No. 6,234,354, entitled "Soft Drink Dispensing Machine with Modular Customer Interface Unit." These patents are incorporated herein by reference.

Present commercially available soft drink dispensing machines typically employ various configurations for mixing syrup and either carbonated or non-carbonated liquid (usually water) in the right proportions and dispensing the mixture to create a homogeneous resultant beverage.

A typical a soft drink dispensing machine is disclosed in U.S. Pat. No. 6,234,354. In this patent a soft drink dispensing machine is disclosed which includes a dispensing head that dispenses multiple beverages via a multi-flavor nozzle having a water inlet port and a plurality of syrup inlet ports. The machine also includes a source of one or more flavored syrups and a source of carbonated water, non-carbonated water, or both. Each of the water inlet ports and the plurality of syrup ports are connected to flexible tubes and ultimately to the source or sources of water and syrups which are delivered via separate multiple pumping means. Syrups have a higher viscosity than water and as such present dispensing machines require the connection of the flexible tubes extending from pressurized syrup containers to the syrup inlet ports. This configuration requires multiple pumps for multiple syrup containers which is expensive and requires large storage areas for the syrup containers and the pumps. It has been found that for a quality beverage made of a water and syrup combination, the ratio of syrup to water is usually about 1 to 5.

Several popular soft drink manufacturers have developed flavored versions of their flagship product. For example, the Coca-Cola Company sells flavored variants of its widely popular soft drink Coke. Such variants include Cherry Coke and Vanilla Coke which are widely distributed in bottles and cans. Flavored versions of the original Coke beverage can be dispensed from soft drink dispensing machines with a "bonus flavor" added to the original Coke beverage mixture.

However, it is a challenge to upgrade existing soft drink dispensing machines in a cost effective manner. Additionally, simply adding additional "bonus" flavor syrups may require additional pumping and chilling means as well as space for the syrup containers. Typically, all water and syrup lines are bundled together and chilled. Any additional "add-on" lines required after the initial installation of the soft drink dispensing machine are difficult to implement and may only be possible in a non-chilled manner. Given the optimum syrup to water ratio of 1 to 5, adding an additional non-chilled syrup will substantially influence the carbonation level, syrup to water ratio and the temperature of the final beverage.

Others have attempted to provide bonus flavor beverages via two separate and distinct dispensing nozzles, one for the original beverage and one for the bonus flavor. However in either a self serve counter environment or a business operator environment it has been found that this method leads to inconsistent beverage quality and wastefulness. Additionally, a typical soft drink dispensing machine contains a limited number, between 4 and 9, of dispensing head from which beverages may be dispensed. It would thus be desirable to provide a flavored and non-flavored beverage from a single dispensing head.

Recent achievements in soft drink technology have lead to the creation of concentrated flavored "essences" that have a viscosity similar to that of water. As such, principles of fluid dynamics apply similarly to both water and the essence used to make various desired resultant flavored beverages.

Venturi valves have also been well known in the art for some time. A Venturi valve utilizes the kinetic energy of one liquid to cause the flow of another and consists of a converging nozzle, a chamber body, and a diffuser. When a Venturi valve is in operation, pressure energy of a motive liquid is converted to velocity energy by a converging nozzle. The high-velocity liquid flow then entrains a suction liquid. Complete mixing of the motive and suction is performed in the valve body and diffuser section. The mixture of liquids is then converted back to an intermediate pressure after passing through the diffuser.

U.S. Pat. No. 5,509,349 discloses the use of a Venturi valve in a cappuccino, latte and espresso brewing machine. Steam flowing through the valve draws in milk, and as desired, air for foaming the milk in a vortex mixer coupled to the output of the valve. In soft drink dispensing machines however, it is desirable to prevent air from entering the system for microbiological purity.

Given the water-like viscous properties of bonus flavored essences, it would be desirable to take advantage of the motive force of a pressurized water source to draw non-pressurized essence into a soft drink dispensing machine and thereby remove the need for multiple expensive and bulky pumping means for the flavored essence and avoid complex retrofit operations.

European markets have been especially akin to use very concentrated, water-based essences for flavored beverages having a ratio of essence to beverage of between about 1 and 2 to 100. The flavored essences are very dense and concentrated requiring fairly precise measured dispensing means. For example, it has been found that optimum essence to beverage ratio is 4 ml of essence per 350 ml of beverage or a ratio of 1.1 to 100.

For all kinds of flavored beverages the essence to beverage ratio will vary depending upon the formula for the selected beverage and or according to local or cultural preferences. For non-flavored beverages the precise ratio is zero essence added to the beverage, or in other words, no flavored essence is added to the selected non-flavored beverage. However, dispensing a flavored and non-flavored beverage from a single dispensing head may create a less than homogeneous beverage due to unwanted residual essence in the dispensing head. Such residual essence in the valve may undesirably contaminate a resultant dispensed beverage. As such there exists a need for a soft drink dispensing machine having dispensing heads with the ability to selectively dispense flavored and non-flavored without cross-contamination.

In addition, it may be more desirable to leave an existing valve structure intact. In some cases it is not cost effective to replace an entire valve structure, for example, when only a single beverage may be considered for the addition of a bonus flavor. In this case, it is desirable to provide a bonus flavor without altering the existing structure and it is desirable to provide such a feature while working within the physical confines of that existing structure.

OBJECTS OF THE PRESENT INVENTION

It is an object of the present invention to provide flavored and non-flavored beverages in a post mix environment from a single dispensing head.

It is a further object of the present invention to provide flavored and non-flavored beverages in a post mix environment from a single dispensing head by upgrading existing soft drink machines in a cost effective and operationally uncomplicated manner.

It is another object of the present invention to provide flavored and non-flavored beverages dispensed from a single dispensing head without cross contamination.

It is still another object of this invention to utilize the motive force of pressurized source water to selectively draw non-pressurized flavored essence into a soft drink dispensing machine.

It is also an object of the present invention to provide a method of preventing cross-contamination between flavored and non-flavored beverages dispensed from a single dispensing head.

It is also an object of the present invention to provide a bonus flavor to an existing valve structure.

It is also an object of the present invention to provide a remote Venturi valve in order to allow bonus flavors to be added to existing valve structures.

It is further an object of the present invention to provide a remote Venturi valve within the physical confine of an existing valve structure.

SUMMARY OF THE INVENTION

An advantage exists in the present invention in that the use of a concentrated bonus flavor essence having water like viscous properties allows use of a Venturi valve to take advantage of the motive forces of pressurized water source in lieu of pressurized essence sources. An additional advantage of the present invention is that the bonus flavor essence line can be selectively opened and closed preventing cross-contamination of beverages. Another advantage of the present invention is that the use of the motive forces of the water source is being used without interaction with existing water or syrup sources so that one can only dispense bonus flavor essence while dispensing water maintaining a constant ratio for a precise mixture throughout each dispensing cycle. Still another advantage of the present invention is the addition of a non-chilled non-pressurized highly concentrated bonus flavor essence line without substantially altering current soft drink dispensing machines in a cost effective manner.

Another advantage of the present invention is that the use of very high concentrated non-chilled and non-pressurized essence in small quantities does not substantially affect carbonation levels of a final beverage. Yet another advantage of the present invention is that use of very high concentrated non-chilled and non-pressurized essence in small quantities does not substantially affect the ratio of water to syrup of a final beverage. Still another advantage of the present invention is that use of very high concentrated non-chilled and non-pressurized essence in small quantities does not substantially affect the temperature of a final beverage.

Accordingly, in a first aspect the present invention is directed to a beverage dispensing head connectable to a water line, a syrup line and a flavor line, having a Venturi valve fluidly connectable to the water line and the flavor line, where the motive force of the water in the water line draws essence into the venturi valve, combines with the water and where the syrup line is then introduced to the combined water and essence. In some embodiments the dispensing head includes a needle control valve fluidly connected to the essence line, where needle control valve controls flow of essence. In some embodiments the dispensing head includes a means for selectively opening and closing the essence line. In some embodiments the dispensing head includes a non-return valve for preventing back flow of the essence line.

In another aspect the present invention is directed to a Venturi valve including an essence inlet port, a converging nozzle, a first chamber, a second chamber, and a diffuser, the first chamber being fluidly connectable to the converging nozzle, the second chamber and the diffuser. In some embodiments the inlet port is fluidly connectable to the second chamber and the essence line and the water flow chamber carries water directed from the water line into the converging nozzle. In some embodiments the water flows through the converging nozzle into the first chamber and through the diffuser creating a low pressure area in the second chamber drawing essence through the inlet port into the second chamber. In still other embodiments the venturi valve includes a plurality of bores extending from the essence inlet port to the second chamber, where the plurality of bores carry essence into the second chamber. In still another embodiment the plurality of bores has a diameter of about 0.8 millimeters. In yet another embodiment the bores arranged parallel and in a concentric pattern relative to the first chamber. In another embodiment of the present invention the water and the essence mix in the diffuser and the diffuser is located substantially near the dispensing nozzle. In still other embodiments the first chamber and the second chamber are cylindrical and concentric. In yet another embodiment the water line contains carbonated water. In another embodiment the essence contains an anti-foaming agent. In another embodiment the means for selectively opening and closing the essence line is a solenoid.

In still another aspect, the present invention is directed to a remote Venturi valve fluidly connected to a water line and at least one flavor line, where the motive force of the water in the water line draws at least one essence into the Venturi valve to combine with the water. In some embodiments the remote Venturi valve is capable of receiving between about 10% to about 50% of water from said water line through an entry port. In some embodiments the remote Venturi valve is capable of emitting the combined water and essence from an exit port into a final beverage container. In some embodiments the remote Venturi valve is capable of interfacing with an existing valve base. Advantageously, the remote Venture valve may be interfaced with an existing valve base located within the physical confines of an existing liquid dispenser. This allows quick and cost efficient supplementing of the existing liquid dispenser with additional bonus flavors without the need for major structural modifications.

The above advantages and features are of representative embodiments only, and are presented only to assist in understanding the invention. It should be understood that they are not to be considered limitations on the invention as defined by the claims, or limitations on equivalents to the claims. Additional features and advantages of the invention will become apparent from the drawings, the following description, and the claims.

BRIEF DESCRIPTION OF THE DRAWINGS

While the specification concludes with claims particularly pointing out and distinctly claiming the present invention, it is believed the same will be better understood from the following description taken in conjunction with the accompanying drawings, which illustrate, in a non-limiting fashion, the best mode presently contemplated for carrying out the present invention, and in which like reference numerals designate like parts throughout the figures, and where broken lines indicate see through views the various dimensions of invention, wherein:

DETAILED DESCRIPTION OF THE PREFERRED EMBODIMENTS

Figure 1:
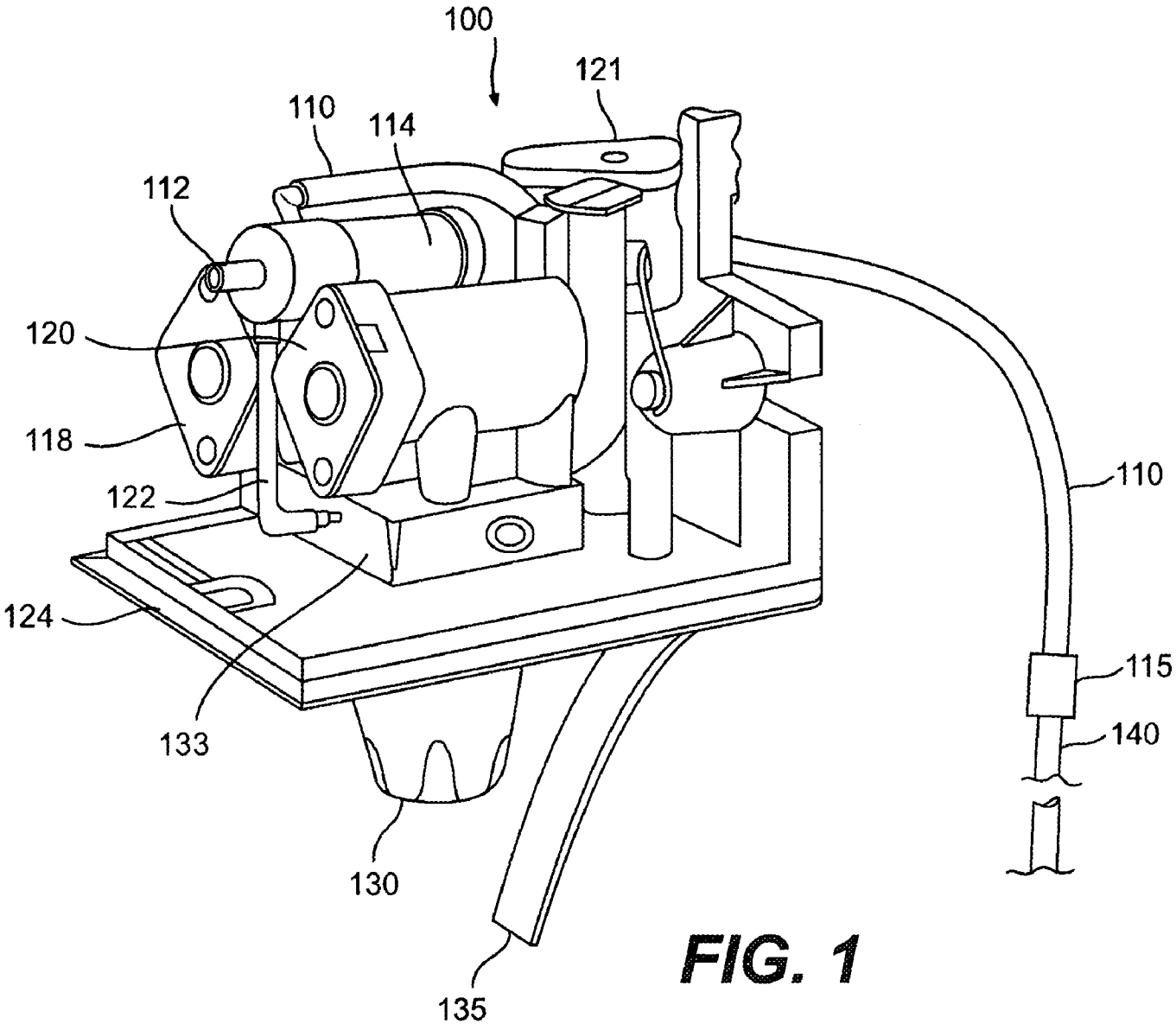
FIG. 1 shows a perspective view of a liquid dispensing device according to one embodiment of the invention.

Referring now to FIG. 1, there is shown a liquid dispenser 100 having a dispense nozzle 130 mounted to the underside of a manifold 124. Also included is a valve base 133, which can be a mollified base, mounted to the top side of manifold 124 and which houses a Venturi valve 105 as shown in greater detail in FIG. 3 and discussed in further detail below. A tube 122 is connected at its lower end to an input port 150 and, at is upper end, to a needle control valve 112. Needle control valve 112 may be controlled by a flow control means 114. Needle control valve 112 may be a solenoid, a toggle valve or suitable control valve.

Figure 2:
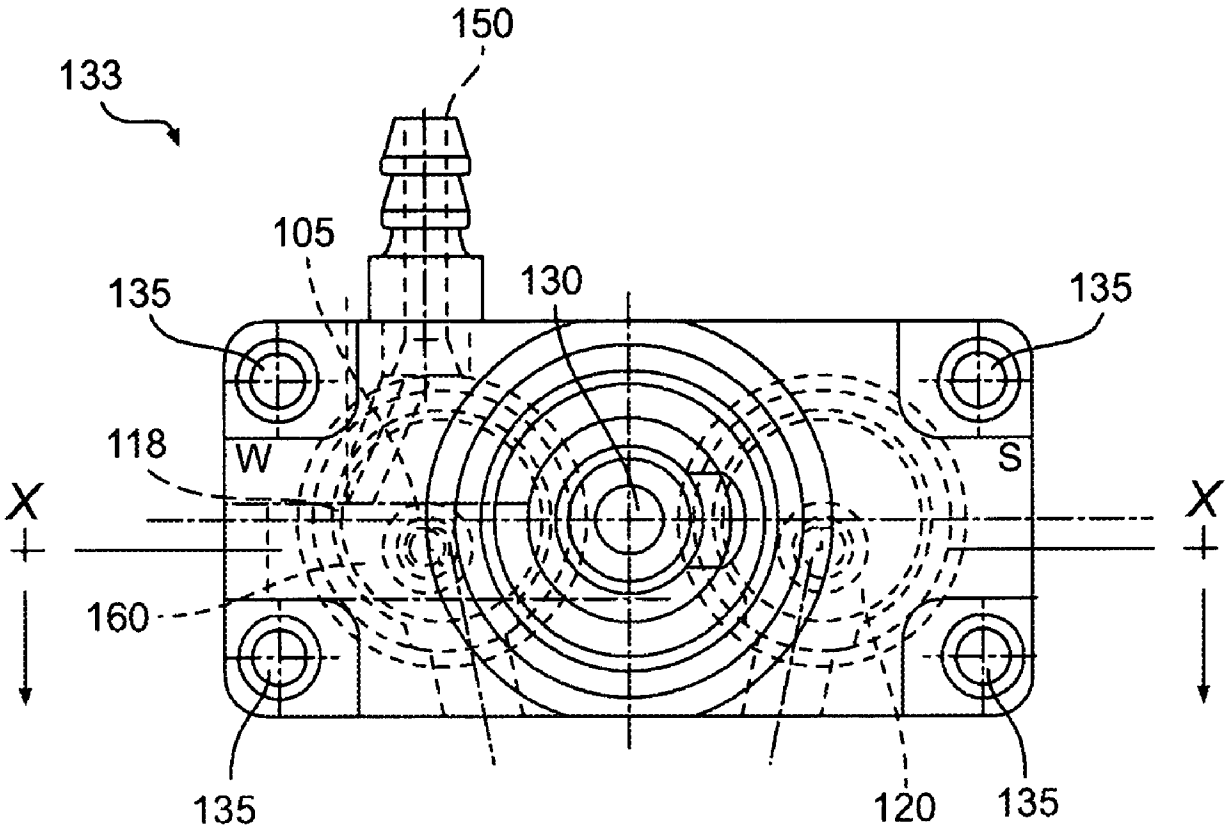
FIG. 2 shows bottom view of a mixing block according to one embodiment of the invention.

Dispenser 100 also includes syrup flow control 120 and water flow control 118 connected to valve base 133. Also included on manifold 124 is solenoid 121, which selectively opens and closes water flow control 118 and syrup flow control 120. Nozzle 130 can be a two-part nozzle. Water is directed through water flow control 118 through a top part of nozzle 130 simultaneous with syrup directed through syrup flow control 120. Water and syrup are mixed in nozzle 130 and upon actuation of switch 135, ultimately dispensed as a homogeneous beverage. Switch 135 can be a lever as shown or other suitable switching means such as a push button, toggle button or rotating valve. As can be seen in FIG. 2, inlet port 150 is located on the water flow control 118 side of valve base 133. Syrup flow control 120 is preferably left in place as it is typically found in presently existing dispensing machines.

When a flavored beverage is selected solenoid 121 preferably opens water flow control 118 and syrup flow control 120 simultaneously as flow control means 114 opens essence line (tubes 110 and 122 as shown). Each of the water, syrup, and essence is flowing simultaneously through liquid dispenser 100 and ultimately into a container under nozzle 133 to combine and make a desired flavored beverage. When a non-flavored beverage is selected flow control means 114 preferably closes the essence line (tubes 110 and 122 as shown) and only the water line and the syrup line are open and the liquid dispenser 100 dispenses only a non-flavored beverage.

Needle valve 112 is preferably adjustable to control the amount of flow through tube 122 and ultimately through Venturi valve 105. Tube 110 is connected to an entry port of the needle valve 112 via flow control means 114. Tube 110 is connected to tube 140 and ultimately to a source of flavored essence. It will be understood by those in the art that other sources may be connected to tube 140. A non-return valve 115 may be employed to prevent fluid from draining the entire or partial length of tube 110 backwards into an essence container. It is important for the present invention that air does not enter the system and reduce pressure as well as for microbiological purposes. Non-return valve 115 is shown external of the manifold 124, however it will be understood that non-return valve 115 may be located at any point on the essence line which includes, tubes 140, 110 and 122. Non-return valve may also be located external of a valve cover (not shown). As shown in the perspective view of liquid dispenser 100 in FIG. 1, tube 110 is directed behind solenoid 122 which is discussed below. Ultimately, tubes 140, 110 and 122 may be a single line that carries essence in Venturi valve 105 as discussed below. Flow control means 114 controls fluid access to needle valve 112. Flow control means 114 may selectively open and close the essence line and may be located at any location along the essence line of tubes 140, 110, and 122. Preferably flow control means 114 is located between tubes 110 and 122 as shown.

Referring now to FIG. 2, there is shown a mollified valve base 133. Venturi valve 105 is shown in dotted lines and is located internal of valve base 133 as also shown in greater detail in FIGS. 3 and 5. Also indicated by dotted lines is water flow control 118 and syrup flow control 120. The "water" side of valve base 133 is indicated by the letter "W" and the "syrup" side is indicated by the letter "S". Nozzle 130 can be seen in solid lines as the view in FIG. 2 is from the underside of the valve base 133. Valve base 133 is secured to manifold 124 via screws 135.

Venturi valve 105 has an inlet port 150 which is connected to tube 122 as shown in FIG. 1. Essence is drawn through tubes 140, 110, needle control valve 112, tube 122 and into inlet port 150 of Venturi valve 105 on the water side of the valve base 133. Venturi valve may include converging nozzle 178, chamber 185, low pressure body chamber 210, diffuser 200 and an exit port or discharge 220.

Figure 3:
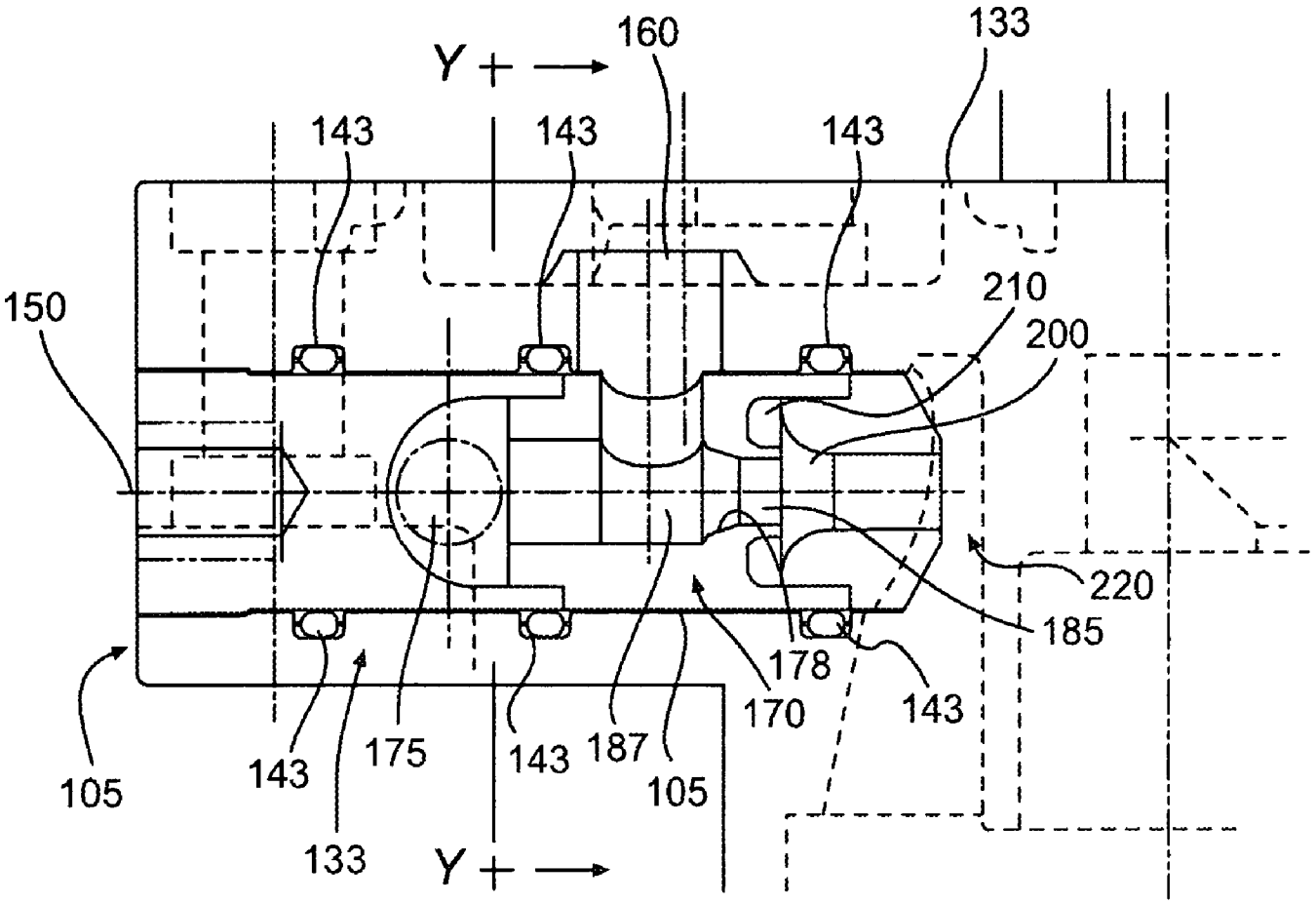
FIG. 3 shows a split view of the mixing block shown FIG. 2 along line X—X according to one embodiment of the invention.
Figure 5:
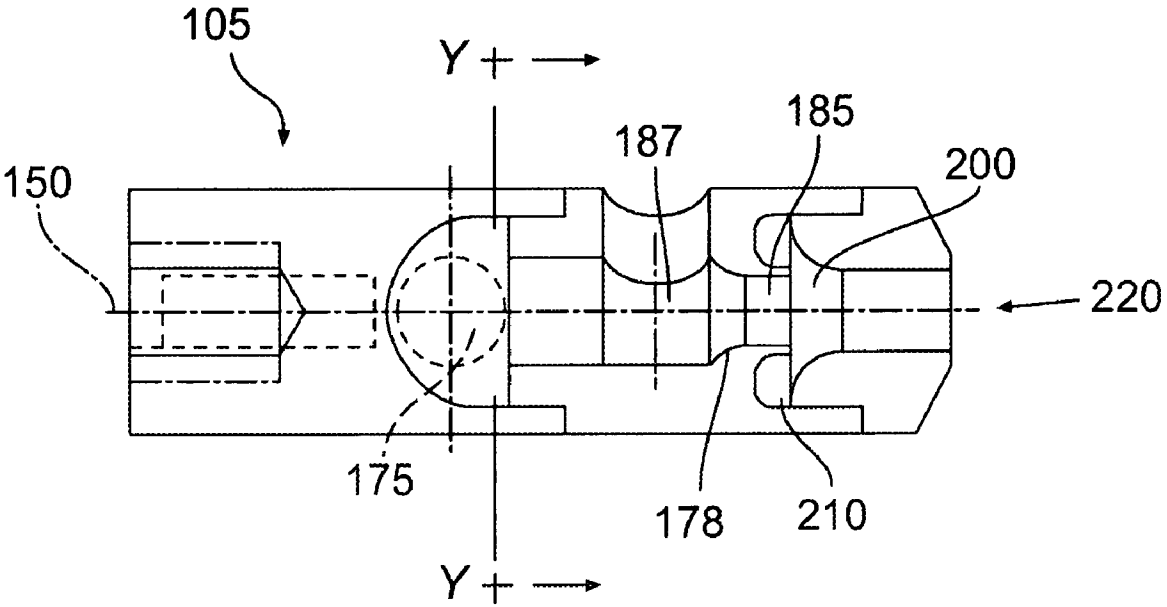
FIG. 5 shows a detailed view of the Venturi valve according to one embodiment of the invention.

Referring now to FIG. 3, there is shown a cross section and expanded view of the water side of valve base 133 along line 'X—X' as indicated in FIG. 2. Venturi valve 105 can be seen within valve base 133. FIG. 5 shows an expanded view of Venturi valve 105 without the surrounding valve base 133. Water inlet port 160 carries pressurized water, either carbonated or non-carbonated, into the valve base 133 and directly into the body 170 of the Venturi valve 105. Water flowing through inlet port 160 enters body 170 and may be directed 90 degrees into chamber 185 via converging nozzle 178. Venturi valve 105 is preferably sealed at numerous locations within valve base 133 with O-rings 143 or other suitable sealing elements.

Figure 4:
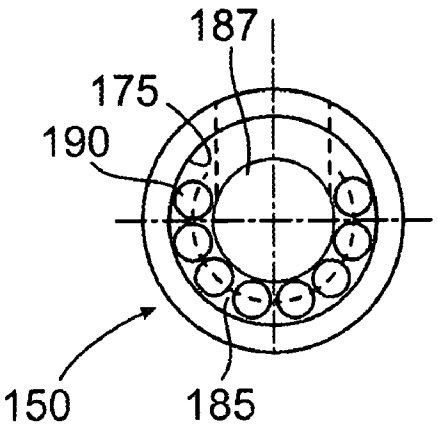
FIG. 4 shows a partial end view of a mixing chamber along line Y—Y shown in FIG. 3 according to one embodiment of the invention.

Inlet port 150, which can be seen in a circular broken line entering spherical chamber 175, carries essence into the Venturi valve 105. FIG. 4 shows a partial end view of inlet port 150 along line 'Y—Y' as indicated in FIG. 3. Inlet port 150 flows into a spherical chamber 175 which houses bores 190. Inlet port 150 carries essence into the chamber 210 via bores 190 where bores 190 preferably extend from spherical chamber 175 to chamber 210.

It is desirable to provide an uncomplicated exchange of non-bonus flavor essence valve bases with the bonus flavor essence valve base according to the present invention. As such valve base 133 is preferably substantially the same size and shape as valve bases used in existing systems and the design requirements for the present invention will likely be dictated by the specifications of presently existing valve bases. Given the specification limitations of presently existing valve bases, bores 190 have a diameter length that is optimized for efficient flow of essence. Preferably, bores 190 are sized to efficiently draw essence from an essence source about 5 meters below the level of liquid dispenser 100. Bores 190 may also have multiple different diameters depending upon the desired flow characteristics. Preferably the diameter length of each bore 190 is about 0.8 millimeters, however other diameter lengths will function equally well depending on the design requirements.

Water inlet port 160 directs water into water bore 187, which is an elbow shaped channel, as shown in the center background of FIG. 4. Water flows into water inlet port 160 through water bore 187 and through a 90 degree angle to converging nozzle 178. As the water enters the converging nozzle 178 the pressure increases as the cross sectional flow area decreases across and through converging nozzle 178. Converging nozzle 178 leads into chamber 185 which has a consistent cross section area throughout its length. Chamber 185 exits into diffuser 200 which is a diverging chamber. As the cross sectional flow area increases the velocity of the water flow increases. Chamber 185 is located proximal to and is fluidly connected to low pressure chamber 210. Preferably low pressure chamber 210 and chamber 185 are concentric cylinders where chamber 210 extends around and beyond chamber 185. The high pressure water is directed through diffuser 200 and eventually through discharge 220 which leads downstream to nozzle 133. The motive force of the pressurized water flowing through the diffuser 200 creates a low pressure zone in body chamber 210. The low pressure zone in body chamber 210 draws essence through bores 190 into body chamber 210. Since bonus flavored essence has a viscosity similar to that of water, principles of fluid dynamics apply in a similar fashion to both water and essence. The essence is entrained in chamber 210 and the two fluid streams are combined and mixed within the throat of diffuser 200. The combined essence and water are then directed through discharge 220 and ultimately to nozzle 133 where the essence and water combination is mixed with syrup and dispensed into a cup.

The essence is combined with the water at or substantially near nozzle 133 in order to prevent cross contamination of beverages. Given the high concentration of the essence, only a small amount of essence is needed for each beverage. Hence, at any given time the system contains a small amount of essence flowing through the various valve elements. The system is preferably configured to dispense consistent amounts of essence and water for each beverage. Control means 114 preferably can open and close essence line (tubes 110 and 122) while needle valve 112 is selectively adjustable to consistently and automatically dispense precise amounts of essence to enter Venturi valve 105 for quality flavored beverages. During dispensing non-flavored beverages control means 114 may close the essence line preventing essence from entering Venturi valve 105. The system is substantially devoid of essence during dispensing of non-flavored beverages because the essence line has been closed by flow control means 114 and any amount of residual essence has been discharged into a previously selected flavored beverage. The present system can advantageously provide selective flavored and non-flavored beverages from a single dispensing head without cross contamination.

Figure 6:
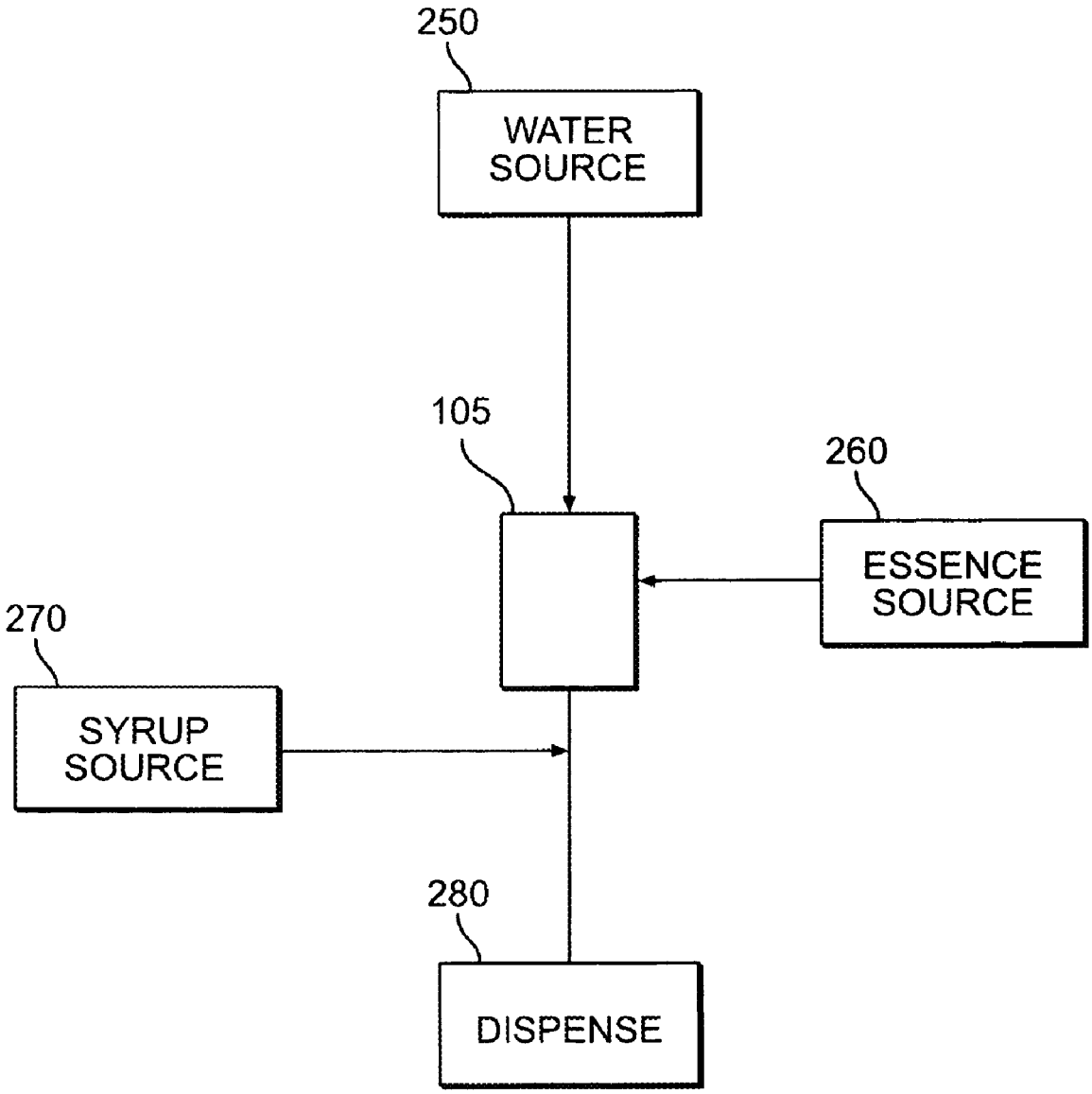
FIG. 6 is a flow diagram according to one embodiment of the present invention.

Referring generally to FIG. 6 a flow diagram is shown. Water from water source 250 is fed into Venturi valve 105. Essence is drawn from essence source 260 into Venturi valve 105 where the water and essence is mixed. Syrup from syrup source 270 is then mixed with the essence and water mixture source and the total mixture is then dispensed 280 into a container.

It will be understood by those skilled in the art that the disclosed system is preferably a closed system where the introduction of ambient air is preferably avoided for microbiological purposes and for maintaining appropriate pressure levels throughout the various valve elements. In alternative embodiments antifoaming agents can be added to either the syrup line or the essence line in order to prevent excess foaming in a resultant beverage.

Figure 7:
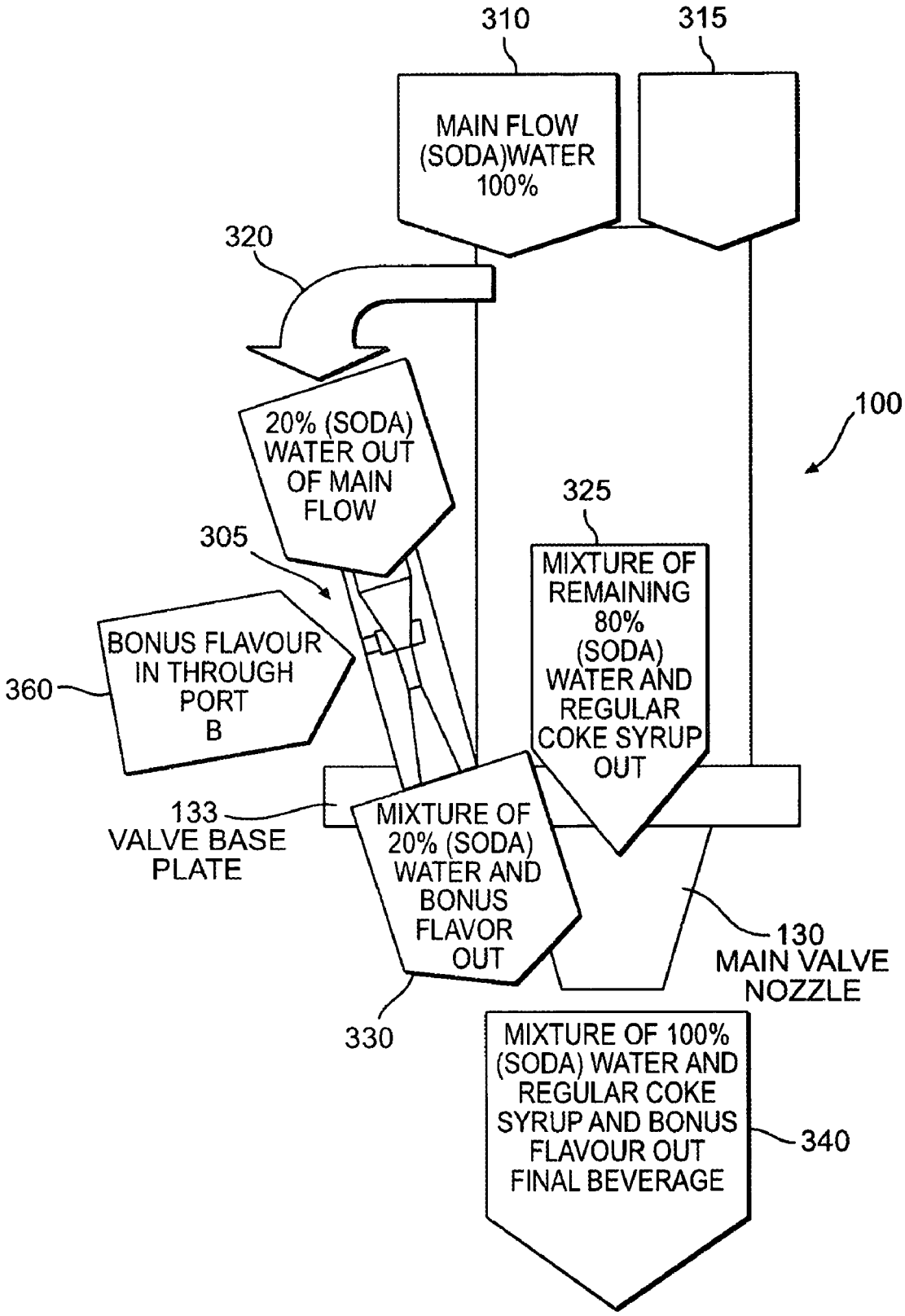
FIG. 7 shows a side view of the liquid dispensing device according to one embodiment of the invention.

Referring now to FIG. 7 there is shown a diagram of an alternative embodiment of the Venture valve system described above. It will be understood that the valve disclosed in FIG. 5 is substantially equivalent to the valve as described in FIGS. 7-9 with the additional elements and features as described below. In FIG. 7 there is shown a schematic drawings of an embodiment of liquid dispenser 100 that receives flavored syrup 315 and main water flow 310 from ports in the top of the dispenser (not shown). External to dispenser 100 there is a Remote Venturi Valve 305 (RVV 305), which receives about 20% water flow 320 of the main flow 310. This will result in about 80% of the main flow 310 being directed through dispenser 100 (see feature 325). It will be understood that feature 320 may range from about 10% to about 50%, while feature 325 may range from about 50% to 100%. However, as disclosed, it may be preferable for proper functioning to maintain the ranges to about 20% for feature 320 and about %80 for feature 325. RVV 305 is capable of working with both carbonated and non-carbonated water.

Still referring to FIG. 7, RVV 305 is located external to dispenser 100 and may be added to existing valve systems to add bonus flavors to regular brand soft drinks. RVV 305 includes bonus flavor port 360 though which a bonus flavor is drawn via the motive force of the water 320 flowing through RVV 305. As discussed above with respect to FIGS. 2–5, the motive force flowing through RVV 305 creates a zone of low pressure in port 360 which draw bonus flavor into the RVV 305 from a draw tube attached to a bonus flavor bag (not shown). The result of this system is that a mixture of 20% water and bonus flavor 330 is then reintroduced with the 80% water and regular syrup (see feature 325) in the main valve nozzle 130 and ultimately dispensed 340 into a cup (not shown).

Figure 8:
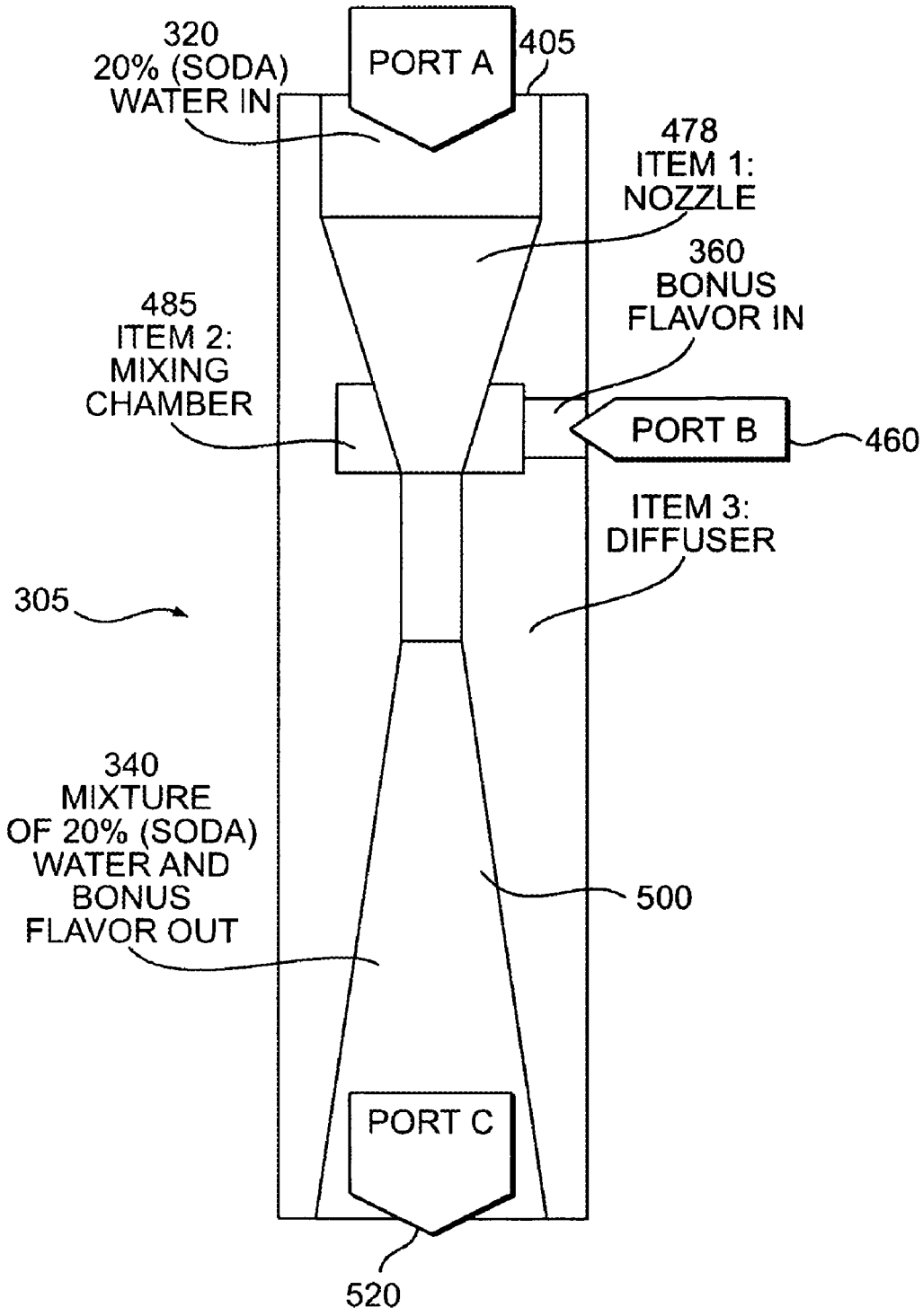
FIG. 8 shows a large side view of the internal sections of a valve as shown in FIG. 7 according to one embodiment of the invention.

Referring now to FIG. 8, there is shown schematic diagram of the RVV 305. RVV 305 may include a port 405 that receives about 20% water in 320. Port 405 leads to a converging nozzle section 478 where the pressure of the water is increased. As the pressurized water passed port 460, which receives a bonus flavor in 360, the bonus flavor is drawn into mixing chamber 485 that is at a lower pressure than the bonus flavor bag (not shown). The 20% water and the bonus flavor 340 are mixed in chamber 485 and then exited through diffuser 500 and exit port 520. This results in a mix of 3 flow streams (soda water, regular syrup and bonus flavour) being pored into the consumer's cup. The two fluid streams coming out of the diffuser 520 are tangentially pored onto the outer main valve nozzle 130. The end poor (final beverage poor) is therefore very similar if not identical to the known combined poor of (soda) water and syrup and excessive foaming is avoided. In some embodiments, dispenser 100 includes supplementary outer cover, so that the outer surface of the main valve nozzle 130 is not physically contacted by the 20% water stream 300 in order to maintain the valve nozzle 103 in an uncontaminated state In some embodiments there may be a separate tube (not shown) that extends from the diffuser is an extension for the diffuser 520. In some embodiments the extended tube may travel through the valve base plate 133 and have a specific direction so that the 20% mixed flow 330 is dispensed in a way that it will tangentially hit an outer wall of the main valve nozzle 130.

Figure 9:
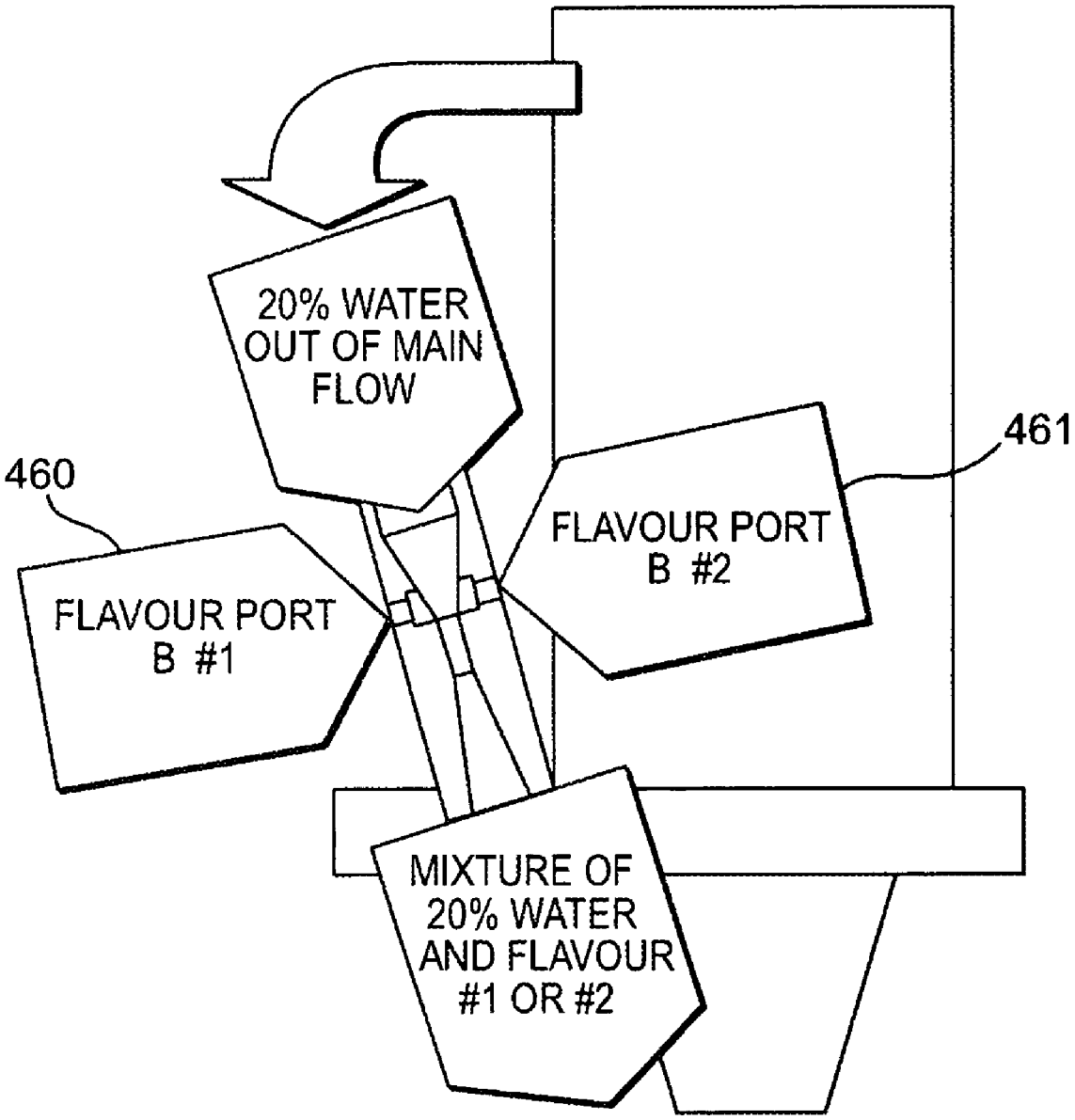
FIG. 9 shows an alternative embodiment of the Venturi Valve shown in FIG. 7 according to one embodiment of the present invention.

Referring now to FIG. 9, there is shown an alternative embodiment of the RVV 305 which includes a second bonus flavor port 461. This allows for multiple bonus flavors to be available for the RVV 305. It will be understood that while FIG. 9 shows RVV 305 having two bonus flavor ports 360, and 361. It is entirely conceivable that additional ports may be available. Further it is also possible to use one or two ports and still have the flexibility of more than two flavors. Although not shown, it is possible to include a T-junction at the entrance of either port 360 or port 362 with multiple feeder lines leading to various bonus flavor bags. In some beverages there are multiple flavors required and hence multiple feeder lines will be open at one time. In these some embodiments, it may necessary to increase the amount of water directed through RVV 305 in order to maintain a suitable pressure in mixing chamber 485. Also not shown, the multiple feeder lines may independently opened and closed with pinching devices and solenoids.

The RVV 305 may is physically integrated underneath the existing valve cover. In a preferred embodiment the outer dimensions of an existing dispensing system will be sufficient to fit the RVV, making the instant invention an attractive solution with regards to retrofitting in the field. Retrofitability is an important feature indeed, in order to smoothen possible market introduction, ease of installation (plug & play, no additional power source, nor an additional CO2 source is required, and low capital investment. However this retrofitability is not a condition sine qua non; such an RVV 305 may be integrated in new installations as well.

For the convenience of the reader, the above description has focused on a representative sample of all possible embodiments, a sample that teaches the principles of the invention and conveys the best mode contemplated for carrying it out. The description has not attempted to exhaustively enumerate all possible variations. Further undescribed alternative embodiments are possible. It will be appreciated that many of those undescribed embodiments are within the literal scope of the following claims, and others are equivalent.

What is claimed is:

1. A remote Venturi valve, comprising:

said remote Venturi valve fluidly connected to a water line and at least one essence line, where the motive force of water in the water line draws at least one essence into the Venturi valve to combine with the water, said remote Venturi valve capable of receiving between about 10% to about 50% of the water in said water line through an entry port, and said remote Venturi valve capable of emitting said combined water and essence from an exit port into a final beverage container; wherein said remote Venturi valve is capable of interfacing with an existing valve base, and wherein the existing valve base receives between about 50% and 90% of the water in said water line and combines syrup from a syrup line such that the existing valve base delivers combined water and syrup into the final beverage container.

2. The remote Venturi valve according to claim 1 further comprising a needle control valve fluidly connected to the essence line, where needle control valve controls flow of essence.

3. The remote Venturi valve according to claim 2 wherein said remote Venturi valve is further capable of interfacing with an existing valve base within an existing liquid dispensing structure.

4. The remote Venturi valve according to claim 1 further comprising a non-return valve for preventing back flow of the essence line.

5. The remote Venturi valve according to claim 1, further comprising an essence inlet port, a converging nozzle, a first chamber, a second chamber, and a diffuser, the first chamber being fluidly connectable to the converging nozzle, the second chamber and the diffuser, and the inlet port being fluidly connectable to the second chamber and the essence line, where the first chamber carries the water directed from the water line into the converging nozzle and where the water flows through the converging nozzle into the second chamber and through the diffuser creating a low pressure area in the second chamber drawing essence through the inlet port into the second chamber.

6. The remote Venturi valve according to claim 5, further comprising a plurality of bores extending from the essence inlet port to the second chamber, where the plurality of bores carry essence into the second chamber.

7. The remote Venturi valve according to claim 6 where each one the plurality of bores has a diameter of about 0.8 millimeters.

8. The remote Venturi valve according to claim 7 where there are eight bores arranged parallel and in a concentric pattern relative to the first chamber.

9. The remote Venturi valve according to claim 8 where the water and the essence mix in the diffuser.

10. The remote Venturi valve according to claim 9 where the diffuser is located substantially near the dispensing nozzle.

11. The remote Venturi valve according to claim 10 where the first chamber and the second chamber are cylindrical and concentric.

12. The remote Venturi valve according to claim 11 where the water line contains carbonated water.

13. The remote Venturi valve according to claim 11 where the essence contains an anti-foaming agent.

14. The remote Venturi valve according to claim 1 further comprising a means for selectively opening and closing the essence line.

15. The remote Venturi valve according to claim 14 where the means .for selectively opening and closing the essence line is a solenoid.

16. A remote Venturi valve, comprising:

an essence inlet port connected to an essence line, a water entry port connected to a water line and a converging nozzle, a first chamber, a second chamber, and a diffuser, the first chamber being fluidly connectable to the converging nozzle, the second chamber and the diffuser, and the essence inlet port being fluidly connectable to the second chamber, where the first chamber carries water directed from the water line into the converging nozzle and where the water flows through the converging nozzle into the second chamber and through the diffuser creating a low pressure area in the second chamber drawing essence through the inlet port into the second chamber;

said remote Venturi valve capable of receiving between about 10% to about 50% of the water in said water line through the water port, and said remote Venturi valve capable of emitting said combined water and essence from an exit port into a final beverage container; wherein said remote Venturi valve is capable of interfacing with an existing valve base and wherein the existing valve base receives between about 50% and 90% of the water in said water line and combines syrup from a syrup line such that the existing valve base delivers combined water and syrup into the final beverage container.

17. A remote Venturi valve, comprising:

said remote Venturi valve fluidly connected to a water line and at least one essence line, where the motive force of water in the water line draws at least one essence into the Venturi valve to combine with the water, said remote Venturi valve further including an essence inlet port, a converging nozzle, a first chamber, a second chamber, and a diffuser, the first chamber being fluidly connectable to the converging nozzle, the second chamber and the diffuser, and the essence inlet port being fluidly connectable to the second chamber and the essence line, where the first chamber carries the water directed from the water line into the converging nozzle and where the water flows through the converging nozzle into the second chamber and through the diffuser creating a low pressure area in the second chamber drawing essence through the essence inlet port into the second chamber, said remote Venturi valve capable of receiving between about 10% to about 50% of the water in said water line through an entry port, and said remote Venturi valve capable of emitting said combined water and essence from an exit port into a final beverage container; wherein said remote Venturi valve is capable of interfacing with an existing valve base, and wherein the remote Venturi valve further comprising a plurality of bores extending from the essence inlet port to the second chamber, where the plurality of bores carry essence into the second chamber.

18. The remote Venturi valve according to claim 17 where each one the plurality of bores has a diameter of about 0.8 millimeters.

19. The remote Venturi valve according to claim 18 where there are eight bores arranged parallel and in a concentric pattern relative to the first chamber.

20. The remote Venturi valve according to claim 19 where the water and the essence mix in the diffuser.

21. The remote Venturi valve according to claim 20 where the diffuser is located substantially near the dispensing nozzle.

22. The remote Venturi valve according to claim 21 where the first chamber and the second chamber are cylindrical and concentric.

23. The remote Venturi valve according to claim 22 where the water line contains carbonated water.

24. The remote Venturi valve according to claim 22 where the essence contains an anti-foaming agent.

* * * * *